US010045609B1

(12) United States Patent
Insua

(10) Patent No.: US 10,045,609 B1
(45) Date of Patent: Aug. 14, 2018

(54) DIVISIBLE AND COLLAPSIBLE TABLE HAVING MOUNTING MEANS

(71) Applicant: Eric Insua, Miami, FL (US)

(72) Inventor: Eric Insua, Miami, FL (US)

( * ) Notice: Subject to any disclaimer, the term of this patent is extended or adjusted under 35 U.S.C. 154(b) by 0 days.

(21) Appl. No.: 15/269,706

(22) Filed: Sep. 19, 2016

Related U.S. Application Data

(60) Provisional application No. 62/220,440, filed on Sep. 18, 2015.

(51) Int. Cl.

| | |
|---|---|
| ***A47B 3/00*** | (2006.01) |
| ***A47B 3/091*** | (2006.01) |
| ***A47B 9/20*** | (2006.01) |
| ***A47B 13/12*** | (2006.01) |
| ***A47B 13/08*** | (2006.01) |
| ***A47G 1/06*** | (2006.01) |
| *A47B 3/08* | (2006.01) |

(52) U.S. Cl.
CPC ..... *A47B 3/091* (2013.01); *A47B 9/20* (2013.01); *A47B 13/088* (2013.01); *A47B 13/12* (2013.01); *A47G 1/06* (2013.01); *A47B 2003/0824* (2013.01); *A47G 2001/0677* (2013.01)

(58) Field of Classification Search
CPC ..... Y10T 403/32008; Y10T 403/32049; Y10T 403/32081; Y10T 403/64; Y10T 403/648; A47B 35/00; A47B 13/08; A47B 13/081; A47B 13/083; A47B 13/086; A47B 13/12; A47B 2003/0827; A47B 3/06; A47B 3/08; A47B 3/0809; A47B 3/0818
USPC ..... 312/114; 108/25, 90, 64, 65, 129, 108/131–133, 13, 11, 19, 27, 158
See application file for complete search history.

(56) References Cited

U.S. PATENT DOCUMENTS

| | | | | | |
|---|---|---|---|---|---|
| 279,290 | A | * | 6/1883 | Von Der Wulbeke | A47B 5/06 108/48 |
| 1,575,954 | A | * | 3/1926 | Walaschek | A47B 1/056 108/65 |
| 1,948,724 | A | * | 2/1934 | Laun | A47B 3/12 108/156 |
| 2,296,782 | A | * | 9/1942 | Fischer | E04B 1/617 108/64 |
| 2,905,513 | A | * | 9/1959 | Kane | A47B 3/00 108/128 |
| D191,272 | S | * | 9/1961 | Ungaro | D6/686 |
| 3,037,831 | A | * | 6/1962 | Craddock | A47B 13/083 108/125 |
| 3,091,487 | A | * | 5/1963 | Gallagher | F16B 2/245 108/64 |
| 3,219,401 | A | * | 11/1965 | Mapson | A47F 9/00 108/27 |
| 3,396,928 | A | * | 8/1968 | Lay | A47B 3/0815 108/129 |
| 3,915,100 | A | * | 10/1975 | Sullivan | A47B 87/002 108/64 |
| 4,802,422 | A | * | 2/1989 | Beard | A47B 5/00 108/185 |
| 4,841,878 | A | * | 6/1989 | Kriegsman | A47B 13/12 108/62 |

(Continued)

FOREIGN PATENT DOCUMENTS

| | | |
|---|---|---|
| CA | 2090135 | * 10/1994 |
| KR | 20020085127 | * 11/2002 |
| WO | 2013165218 | * 11/2013 |

*Primary Examiner* — Janet M Wilkens
(74) *Attorney, Agent, or Firm* — Sanchelima & Associates, P.A.; Christian Sanchelima; Jesus Sanchelima

(57) ABSTRACT

A table that can be divided into separate sections, each section capable of being hung on a wall as a picture frame. When the sections are combined a table is defined that can be folded along a partition. The table further includes retractable, telescopic legs. A plurality of clamp members are used to hold a backing member in place, which provides support for a graphic mounted within the table top assembly.

8 Claims, 4 Drawing Sheets

(56) References Cited

U.S. PATENT DOCUMENTS

| | | | | |
|---|---|---|---|---|
| 5,144,888 | A * | 9/1992 | Heine | A47B 87/002 108/64 |
| 6,367,392 | B2 * | 4/2002 | Moore | A47B 13/12 108/27 |
| 6,485,219 | B1 * | 11/2002 | Beyer | A47B 87/008 108/64 |
| 8,381,661 | B2 * | 2/2013 | Hilde | A47B 43/00 108/42 |
| 2002/0145365 | A1 * | 10/2002 | Johnson | A47G 1/12 312/114 |
| 2002/0159246 | A1 * | 10/2002 | Murasko | A47B 13/12 362/84 |
| 2008/0251413 | A1 * | 10/2008 | Blumenau-Bebry | A47G 1/0605 206/562 |
| 2009/0199746 | A1 * | 8/2009 | Horton | A47B 3/00 108/129 |
| 2009/0279943 | A1 * | 11/2009 | Wylde | F16M 11/38 403/83 |
| 2015/0033606 | A1 * | 2/2015 | Dinlocker | A47G 1/14 40/727 |
| 2015/0250300 | A1 * | 9/2015 | Watts | A47B 3/0818 108/18 |
| 2015/0289647 | A1 * | 10/2015 | Lin | A47B 87/002 108/64 |
| 2016/0174701 | A1 * | 6/2016 | Boylston | A47B 5/02 108/42 |

* cited by examiner

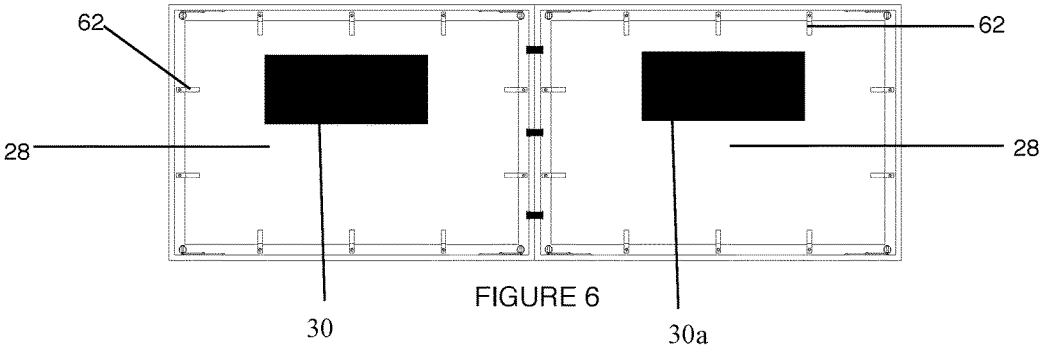
FIGURE 6
FIGURE 7
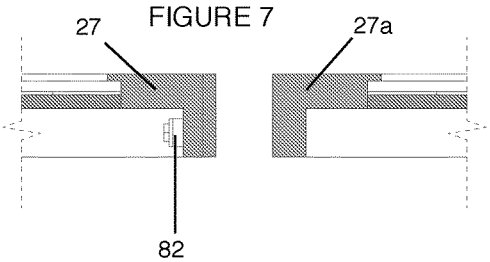
FIGURE 8
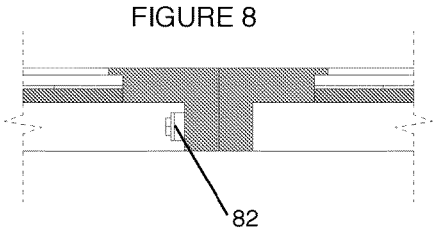
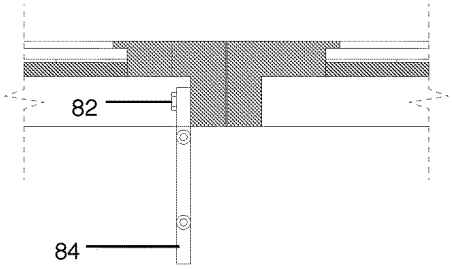
FIGURE 9
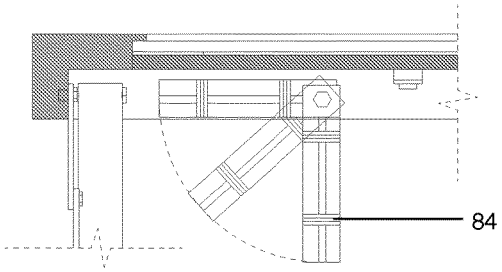
FIGURE 9a
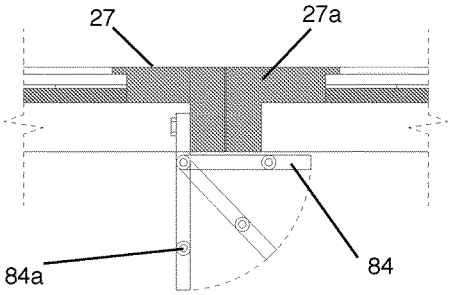
FIGURE 10
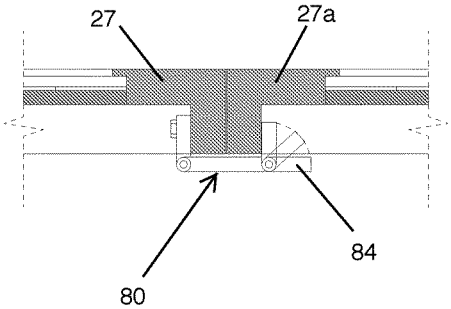
FIGURE 11

DIVISIBLE AND COLLAPSIBLE TABLE HAVING MOUNTING MEANS

BACKGROUND OF THE INVENTION

1. Field of the Invention

The present invention relates to a collapsible table and, more particularly, to such a table that can be partitioned and hung on a wall to frame an image or graphic.

2. Description of the Related Art

Several designs for tables have been designed in the past. None of them, however, include collapsible means to retract the table to a dimension that permits ergonomic transportation and storage. Also, none of the references in the prior art teach of a table that can be divided or partitioned and hung on a wall to display an image or graphic.

Applicant believes that a related reference corresponds to U.S. Pat. No. 4,631,643 issued to Koester Detlef for a demountable multi-purpose light table. However, it differs from the present invention because the Koester reference does not teach or motivate one of ordinary skill in the art to create a table that can be partitioned while still being able to be combined to create a continuous table and/or display a full image or graphic. Also, the Koester reference fails to disclose of a table that after being partitioned includes mounting means to hang the individual sections of the table on a wall or similar surface.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a table that can be combined from independent sections and can—separately or in unison—display an image or graphic mounted securely therein.

It is another object of this invention to provide a table that can be collapsed using a retracting leg assembly and folded to allow for easy storage and It is still another object of the present invention to provide an attachment means to a wall so the table can be used as a picture frame.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 6 is a bottom view of the present invention wherein clamping members 62 are all extended supporting backing member 28 and table sections 22*a*; 22*b* are combined.

FIG. 7 shows a front elevational view of inner table distal ends 27; 27*a* of table sections 22*a*; 22*b*, respectively, in the separated position.

FIG. 8 shows a front elevational view of inner table distal ends 27; 27*a* of table sections 22*a*; 22*b*, respectively, in combined but not yet secured together.

FIG. 9 shows a front elevational view of inner table distal ends 27; 27*a* of table sections 22*a*; 22*b*, respectively, in the combined position with attachment mechanism 82 having hinged attachment members 84 mounted thereon.

FIG. 9*a* shows a side elevational view of inner table distal ends 27; 27*a* of table sections 22*a*; 22*b*, respectively, in the combined position with attachment mechanism 82 having hinged attachment members 84 mounted thereon.

FIG. 10 shows a front elevational view of inner table distal ends 27; 27*a* of table sections 22*a*; 22*b*, respectively, in the combined position with attachment mechanism 82 having hinged attachment member 84 mounted thereon. The rotation of attachment member 84 can be appreciated.

FIG. 11 shows a front elevational view of inner table distal ends 27; 27*a* of table sections 22*a*; 22*b*, respectively, in the combined position with attachment mechanism 82 having hinged attachment member 84 mounted thereon. Hinged attachment member 84 can be seen connecting table sections 22*a*; 22*b*.

DETAILED DESCRIPTION OF THE EMBODIMENTS OF THE INVENTION

Figure 1:
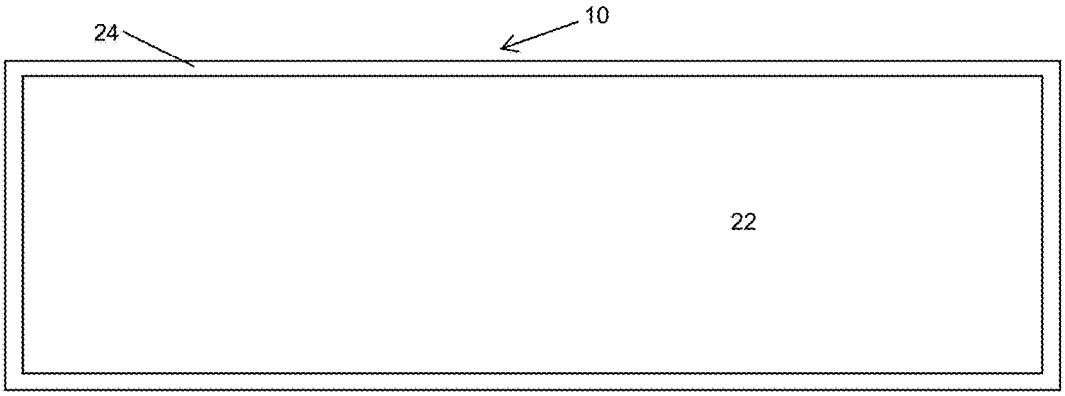
FIG. 1 represents a top view of image 22 mounted within table top frame 24.

Referring now to the drawings, where the present invention is generally referred to with numeral 10, it can be observed that it basically includes table assembly 20, leg assembly 40, image attachment assembly 60, and table section mounting assembly 80.

Figure 1A:
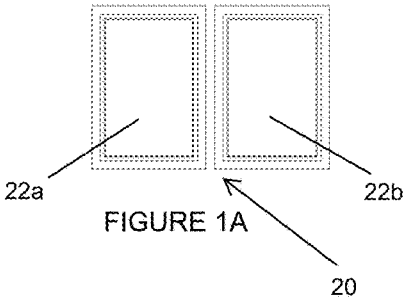
FIG. 1A shows a top view of table top sections 22*a*; 22*b* separated from each other and ready to be hung on a wall.
Figure 2:
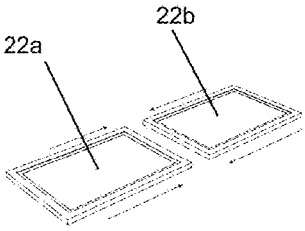
FIG. 2 illustrates the direction in which table top sections 22*a*; 22*b* are urged together when combined.
Figure 3:
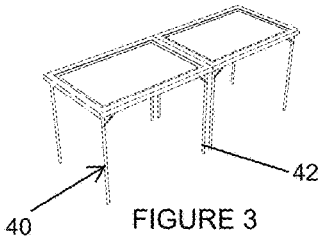
FIG. 3 is a representation of the present invention showing leg members 42 of leg assembly 40 in the completely extended position creating an abutting engagement with the ground.

As shown in FIGS. 1-1A, table assembly 20 includes a graphic portion 22 that is affixed onto at least one table section 22*a*; 22*b*. As shown in FIG. 2, table sections 22*a*; 22*b* can optionally be detached from each other for storage or for hanging each section on a wall independently of each other. As seen in FIG. 3, table assembly 20 can include leg assembly 40 extending therefrom to define a table being supported by a plurality of leg members 42. In an alternate embodiment, leg members 42 are telescopic to facilitate their retraction and storage. Leg members 42, in another alternate embodiment seen in FIG. 19, can be detachable and mounted to table assembly 20 in a twisting motion.

Figure 4:
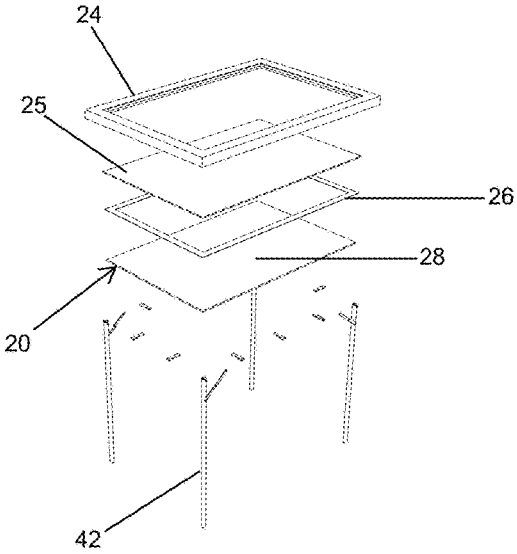
FIG. 4 shows an exploded view displaying the different layers of table assembly 20 including top frame member 24, transparent layer 25, matting frame 26, and backing member 28.

As shown in FIG. 4, table assembly 20 includes top frame member 24 cooperatively mounted around transparent layer 25. Transparent layer 25 is sequentially mounted to matting member 26 that is then mounted to backing member 28. Graphic portion 22 can be positioned on backing member 28 giving it support while matting member 26 and transparent layer 25 center graphic portion 22 in place and provide protection.

Figure 5:
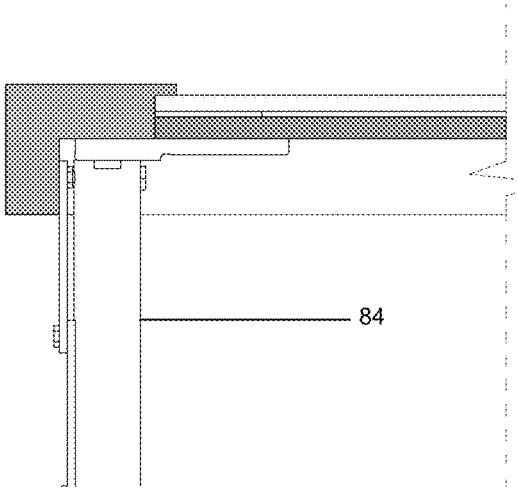
FIG. 5 is an enlarged partial view of a corner of table assembly 20 wherein clamping member 62 can be seen extended and supporting backing member 28.

As also seen in FIG. 4, image attachment assembly 60 includes a plurality of clamp members 62 that extend along the perimeter of the bottom of table assembly 20. As shown in FIG. 5, clamping members 62 are positioned adjacent to backing member 28 and are used to provide it support. As shown in FIG. 6, clamping members are mounted to frame member 24 and extend inwardly across a predetermined portion of backing member 28 to hold image 22 in place between transparent layer 25 and backing member 28.

As shown in FIGS. 7-11, table section mounting assembly 80 includes attachment mechanism 82 that include hinged attachment members 84 extending therefrom. Attachment mechanism attaches to inner table section distal ends 27; 27*a*. As shown in FIGS. 9-11, hinged attachment members 84 include a predetermined amount of hinges 84*a* to cooperate with manipulating around inner table section distal ends 27; 27*a*. Hinged attachment members 84 are mounted to attachment mechanism 82 connected to a first inner table section distal end 27 at one end. Once hinged attachment member 84 is hingedly rotated around the second inner table section distal end 27*a* it is mounted thereto as shown in FIG. 11.

Figure 12:
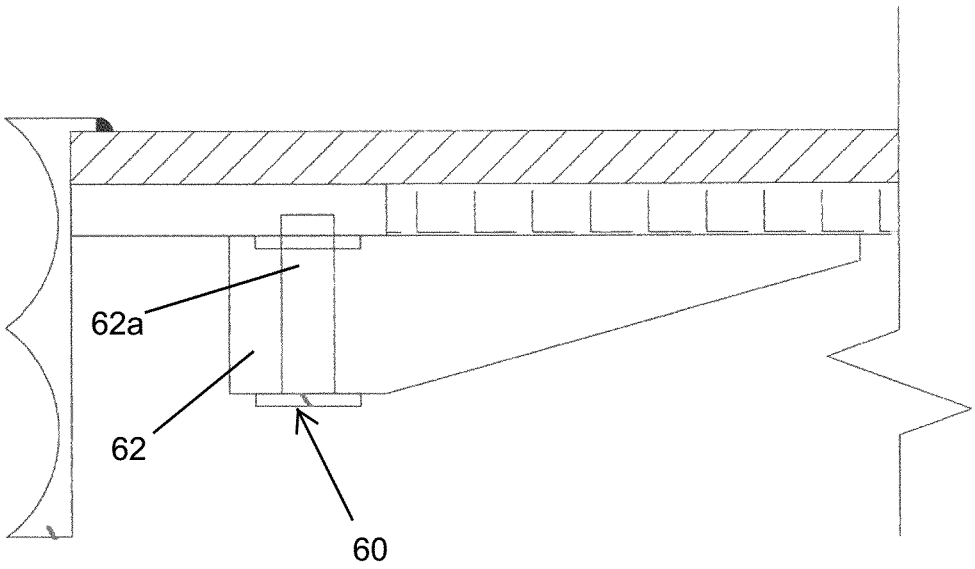
FIG. 12 shows a partial, cross-sectional view of transparent layer 25 mounted on backing member 28 using clamp members 62. Clamp members 62 can be seen mounted to table assembly 20 using clamp attachment means 62*a*.
Figure 13:
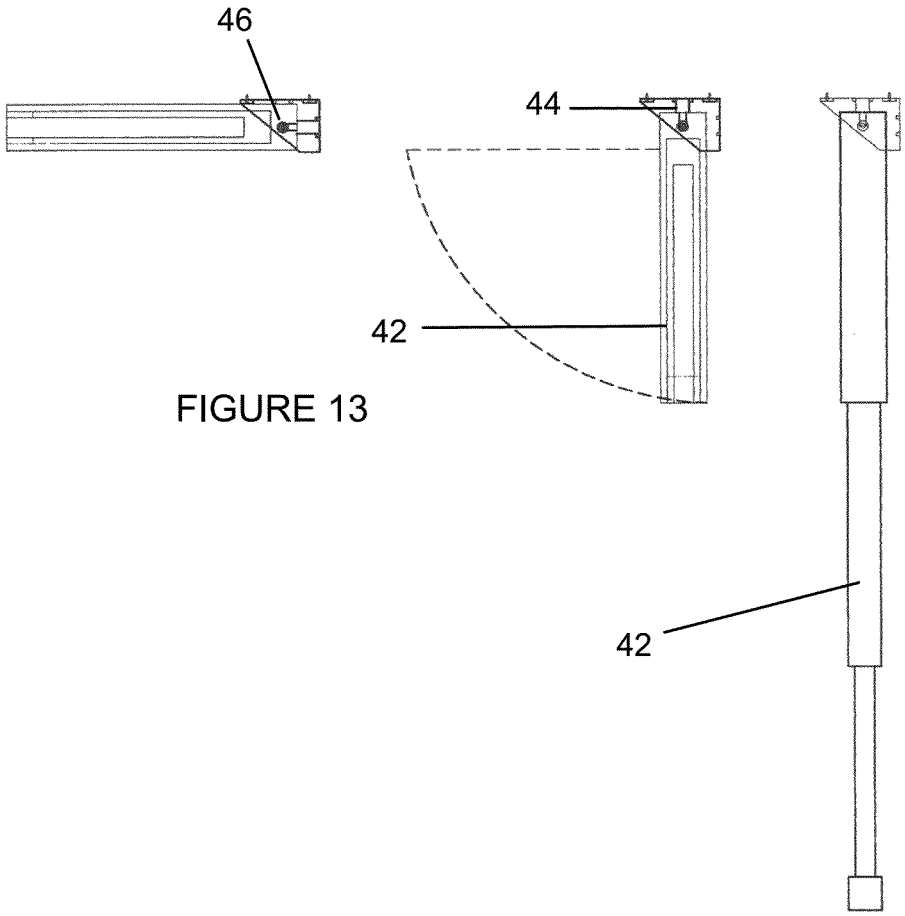
FIG. 13 shows the telescopic and retractable characteristics of leg assembly 40. Spring-loaded bolt 44 is mounted to the upper distal end of leg member 42 and is actuated by button 46 to allow it to telescopically retract leg members 42 towards table assembly 20.
Figure 14:
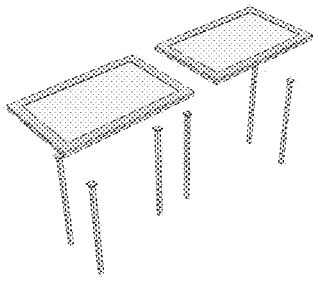
FIG. 14 shows a top isometric view showing an alternate embodiment wherein leg member 42 are detachable.

As shown in FIG. 12, transparent layer 25 can be made of a clear polycarbonate material that has scratch-resistant properties. As shown in the sequence of images in FIG. 13, leg members 42 include a spring-loaded bolt 44 that are actuated using buttons 46. A user uses buttons 46 to release spring-loaded bolt 44 to telescopically retract leg member 42 until it locks in place. Once retracted downward, the telescopic sections of leg members 42 can be extended to provide a secure engagement with the ground.

Graphic portion 22 is mounted to leg members 42, which extend downwardly from the four corners therefrom. Table sections 22*a*; 22*b* can be separated using partition 23. Clamp members 62 are positioned within the inner perimeter therein and are extended inwardly to receive and support backing member 28. Once backing member 28 is positioned, matting frame member 26 is used to secure it in place. Graphic portion 22 can be placed on top of backing member 28 and also secured using matting frame member 26. Lastly, transparent layer 25 is journaled within matting frame member 26 to create a secure engagement.

Leg members 42 can folded inwardly like a suitcase using leg hinges 45 (shown in FIG. 17). Table assembly 20 can then be folded at partition 23 to create a compact configuration that is easy to store and transport.

Optionally, each table section 22*a*; 22*b* can include wall mounting means 30; 30*a* to connect each table section to a wall so they can act as picture frames. In essence, they can act as picture frames when separated or as a table displaying an image when combined.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A table, comprising:

at least two table sections;

each of said at least two table sections having L-shaped inner distal ends;

said table sections including a top frame member, a transparent layer, and a backing member;

said top frame member having a plurality of swivel tabs that extend inwardly and cooperate with said backing member to hold a graphic in place between said transparent layer and said backing member;

a table section mounting assembly that includes hinged attachment members that attach to the inner distal ends of said at least two detachable table sections;

said L-shaped inner distal end defined by a horizontal portion and a vertical portion perpendicularly mounted to said horizontal portion, said vertical portion having an inner surface;

said hinged attachment members defined by a first member, a second member, and third member, said three members being hingedly mounted to each other, said first member connected directly to said inner surface of one of said at least two table sections, said second member extending across the width of two vertical portions adjacent to each other, and said third member folding upwards and against said inner surface of one of said at least two table sections being connected thereto; and said at least two table sections including wall mounting members.

2. The table of claim 1 wherein said at least two table sections include at least three leg members extending underneath each of said at least two table sections.

3. The table of claim 2 wherein said at least three leg members are folded inwardly.

4. The table of claim 2 wherein each of said at least three leg members is telescopic.

5. The table of claim 2 wherein said at least three leg members are detachable.

6. The table of claim 5 wherein said at least three leg members are mounted to said at least two table sections using a twisting motion.

7. The table of claim 1 wherein said transparent layer is made of a clear polycarbonate, scratch-resistant material.

8. The table of claim 1 wherein said top frame member is mounted around said transparent layer said transparent layer is mounted over said backing member, a graphic is positioned between said transparent layer and said backing member.

* * * * *